US009181649B2

(12) United States Patent
Koo et al.

(10) Patent No.: US 9,181,649 B2
(45) Date of Patent: Nov. 10, 2015

(54) WASHING METHOD AND WASHING MACHINE

(75) Inventors: Bon Kwon Koo, Seoul (KR); Kyo Soon Chae, Seoul (KR); Byung Keol Choi, Seoul (KR); Deok Kyu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 978 days.

(21) Appl. No.: 12/883,785

(22) Filed: Sep. 16, 2010

(65) Prior Publication Data

US 2011/0067185 A1 Mar. 24, 2011

(30) Foreign Application Priority Data

Sep. 21, 2009 (KR) ..... 10-2009-0089155

(51) Int. Cl.

| | |
|---|---|
| ***D06F 35/00*** | (2006.01) |
| ***D06F 33/02*** | (2006.01) |
| ***D06F 37/20*** | (2006.01) |
| *D06F 39/00* | (2006.01) |

(52) U.S. Cl.

CPC ..... *D06F 35/007* (2013.01); *D06F 33/02* (2013.01); *D06F 37/203* (2013.01); *D06F 39/005* (2013.01)

(58) Field of Classification Search

CPC ..... D06F 35/007; D06F 37/203; D06F 33/02

USPC ..... 68/12.04, 12.06; 8/158–159

See application file for complete search history.

(56) References Cited

U.S. PATENT DOCUMENTS

| | | | | |
|---|---|---|---|---|
| 4,432,111 | A * | 2/1984 | Hoffmann et al. | 8/158 |
| 5,325,677 | A * | 7/1994 | Payne et al. | 68/12.04 |
| 5,906,020 | A * | 5/1999 | Swint | 8/159 |
| 6,578,225 | B2 * | 6/2003 | Jonsson | 8/159 |
| 7,331,075 | B2 * | 2/2008 | Lee et al. | 8/159 |
| 7,530,133 | B2 * | 5/2009 | Mitts | 8/159 |
| 7,905,121 | B2 * | 3/2011 | Ikemizu et al. | 68/12.06 |
| 2006/0005319 | A1 * | 1/2006 | Park | 8/158 |
| 2007/0050918 | A1 * | 3/2007 | Kim et al. | 8/158 |
| 2009/0183319 | A1 * | 7/2009 | Chai et al. | 8/159 |
| 2010/0000267 | A1 * | 1/2010 | Leidig et al. | 68/23 R |
| 2010/0011515 | A1 * | 1/2010 | Rhodes | 8/159 |

FOREIGN PATENT DOCUMENTS

| | | | |
|---|---|---|---|
| EP | 1736590 | A1 * | 12/2006 |
| JP | 06-063282 | | 3/1994 |
| KR | 10-1995-0018830 | | 7/1995 |
| KR | 10-1999-0004063 | | 1/1999 |
| KR | 10-1999-0056890 | | 7/1999 |

OTHER PUBLICATIONS

Additional machine translation of KR1019950018830, dated Jul. 1995.*

* cited by examiner

*Primary Examiner* — Michael Barr
*Assistant Examiner* — Kevin G Lee
(74) *Attorney, Agent, or Firm* — Dentons US LLP

(57) ABSTRACT

A washing method and a washing machine are provided. Wash water is drained from a tub prior to initiating a main spinning process, and wash water is supplied into a drum to decrease the volume of the laundry which is increased by the draining. Therefore, it is possible to effectively reduce the volume of laundry and thus to improve the mobility of the laundry. Then, a main spinning process is performed by spinning the drum at high speed.

20 Claims, 6 Drawing Sheets

WASHING METHOD AND WASHING MACHINE

CROSS-REFERENCE TO RELATED APPLICATION

This application claims priority from Korean Patent Application No. 10-2009-0089155 filed on Sep. 21, 2009 in the Korean Intellectual Property Office, the disclosure of which is incorporated herein by reference in its entirety.

BACKGROUND OF THE INVENTION

1. Field of the Invention

The present invention relates to a method of washing laundry and a washing machine for washing laundry.

2. Description of the Related Art

Washing machines are devices for removing dust and dirt from clothes or other laundry items by performing a wash cycle, a rinse cycle and a spin cycle. Conventionally, during a water-draining process, the volume of laundry in the drum of a washing machine may increase due to a reduction in the amount of wash water contained in the laundry. Thus, the mobility of the laundry may decrease. As a result, during a laundry-balancing process, which follows the water-draining process, the laundry may not be able to be properly balanced (i.e., de-tangled and re-distributed in the drum). Therefore, it may take a considerable amount of time to begin the main spinning process, or it may be even impossible to begin the main spinning process due to numerous repetitions of the laundry-balancing process and a unbalanced degree of the laundry measurement process.

SUMMARY OF THE INVENTION

The present invention provides a method of washing laundry and a washing machine for washing laundry which reduces the volume of laundry, increases the mobility of the laundry, and evenly distributes the laundry in the drum of the washing machine by spraying wash water onto the laundry during a rinse or spin cycle.

The present invention also provides a method for washing laundry and a washing machine for washing laundry which evenly distributes laundry whose volume tends to fluctuate.

According to an aspect of the present invention, there is provided a laundry washing method for a washing machine that includes a tub and a drum within the tub. The method comprises draining wash water from the tub prior to initiating a main spinning process; supplying wash water into the drum; redistributing the laundry in the drum by repeatedly accelerating and decelerating the rotation of the drum; and performing the main spinning process by spinning the drum at a relatively high speed thereby extracting wash water from the laundry.

According to another aspect of the present invention, there is provided a washing machine that comprises a tub; a drum positioned the tub; a driving unit configured for rotating the drum; a pump; and a control unit configured to: operate the pump so as to drain wash water from the tub prior to the initiation of a main spinning process; control the supplying of wash water into the drum; control the driving unit to accelerate and decelerate drum rotating thereby redistributing laundry inside the drum which is soaked by the wash water supplied into the drum; and initiate the main spinning process by activating the driving unit to rotate the drum at a relatively high speed thereby extracting wash water from the laundry.

BRIEF DESCRIPTION OF THE DRAWINGS

The features and advantages of the present invention will become more apparent from reading the Detailed Description of the Invention which makes reference to the attached drawings in which.

DETAILED DESCRIPTION OF THE INVENTION

Figure 1:
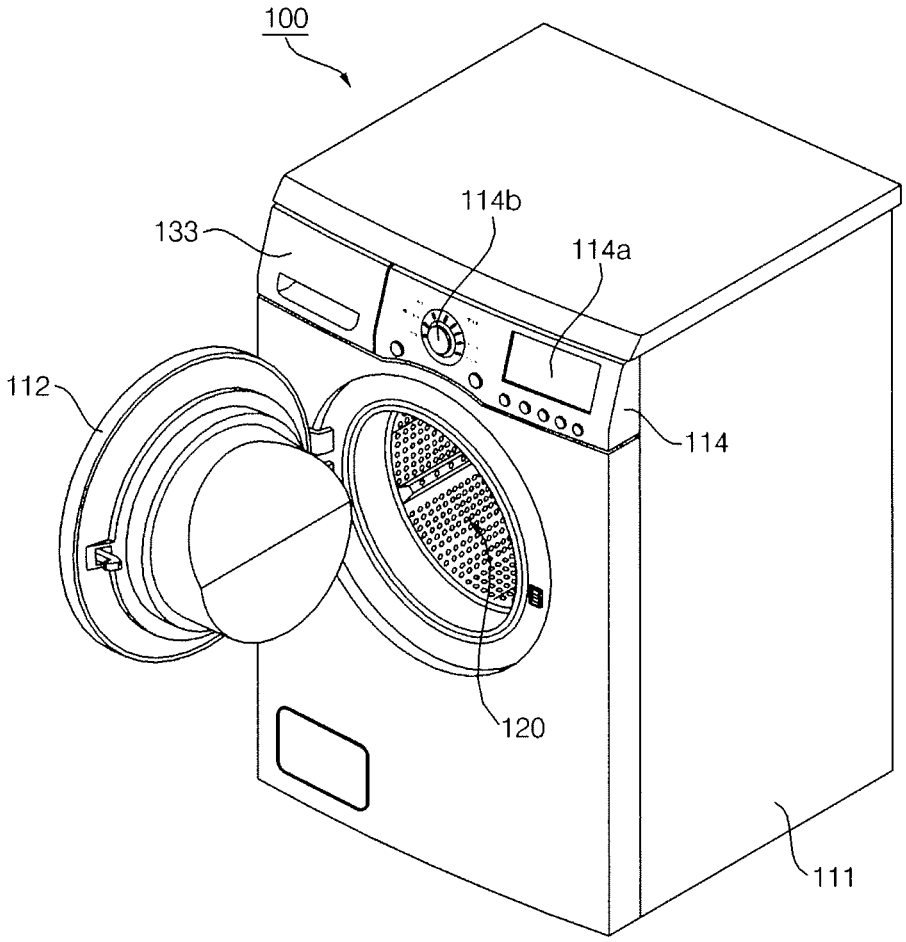
FIG. 1 illustrates a perspective view of a washing machine according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Like reference numerals in the drawings denote like elements.

A washing method and a washing machine according to exemplary embodiment of the present invention will hereinafter be described in detail with reference to FIGS. 1 through 7.

Figure 2:
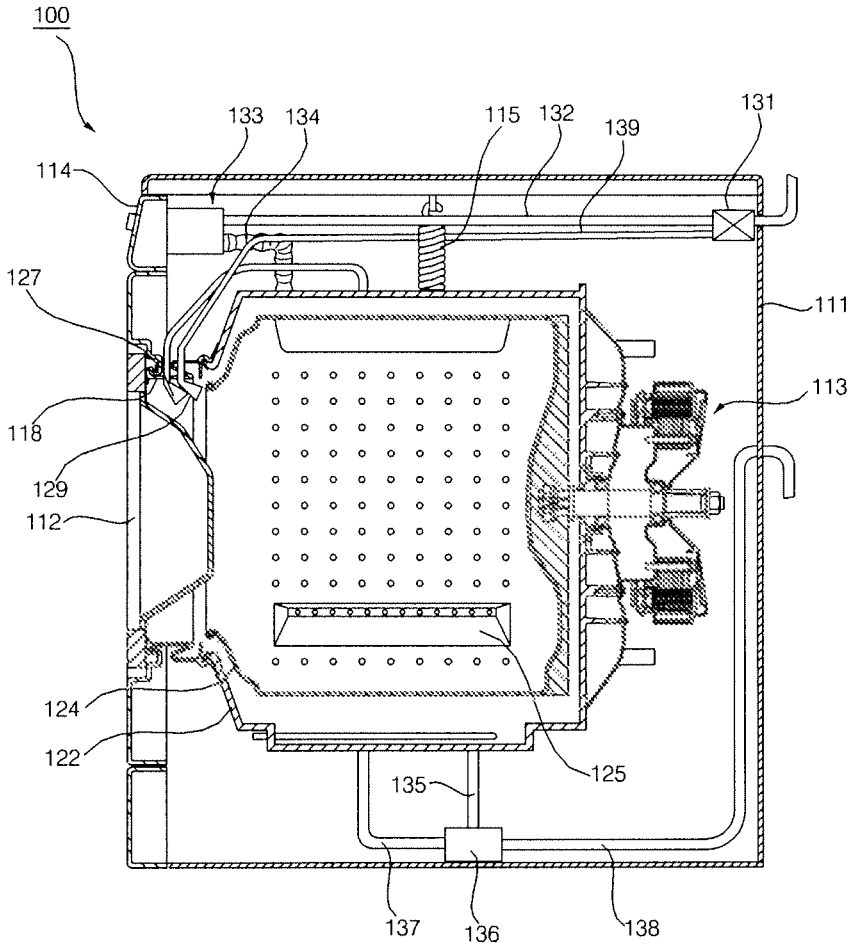
FIG. 2 illustrates a cross-sectional view of the washing machine shown in FIG. 1.

FIG. 1 is a perspective view of a washing machine 100 according to an exemplary embodiment of the present invention. FIG. 2 is a cross-sectional view of the washing machine 100. Referring to FIGS. 1 and 2, the washing machine 100 may include a cabinet 111, which forms the exterior of the washing machine 100, and a door 112 which opens and closes one side of the cabinet 111 so as to allow laundry to be placed in or taken out of washing machine 100. The washing machine 100 also includes a tub 122 which is disposed in and supported by the cabinet 111, and a drum 124 which is disposed in the tub 122. A driving unit 113 rotates the drum 124 by applying torque to the drum 124. The washing machine 100 further includes a detergent box 133, which contains detergent, and a control panel 114 which receives various user inputs and displays information indicating the operating state of the washing machine 100.

The cabinet 111 includes an opening 120 through which laundry can be placed into or removed from the washing machine 100. The door 112 may be rotatably coupled to the cabinet 111 so as to cover or uncover the opening 120. The control panel 114 may be provided on the cabinet 111 as shown, for example. The detergent box 133 may be removable from the cabinet 111.

The tub 122 may be supported in the cabinet 111, for example, by a spring 115 and a damper (not shown). During a washing operation, the tub 122 and the drum 124 may contain wash water. The drum 124 may be disposed in the tub 122. A gasket 118 may be provided between the tub 122 and the cabinet 111 and thus may hermetically seal the space between the tub 122 and the cabinet 111. First and second spray nozzles 127 and 129 may be provided at the gasket 118.

The first and second spray nozzles 127 and 129 may spray wash water into the drum 124.

The drum 124 may include a plurality of holes through which wash water can pass. A lifter 125 may be disposed in the drum 124. The lifter 125 may lift laundry to a predetermined height during the rotation of the drum 124. As mentioned, the drum 124 may be rotated by the driving unit 113. The driving unit 113 may include a motor, a switching device for controlling the motor and a clutch.

The detergent box 133 is designed to hold detergent, fabric softener and/or a bleach. The detergent box 133 may be configured so that it can be removed from the front of the cabinet 111. The detergent contained in the detergent box 133 may be mixed with wash water and may then be injected into the tub 122.

Additional features include a water supply valve 131, through which wash water from an external water source can be supplied into the washing machine 100, a first water supply path 132, which guides the wash water supplied through the water supply valve 131 into the detergent box 133, a water supply tube 134 which guides wash water mixed with the detergent in the detergent box 133 into the tub 122 and drum 124. A second water supply path 139, which guides the wash water supplied through the water supply valve 131 to the second spray nozzle 129, may be provided in the cabinet 111.

A water-drain tube 135, through which wash water is discharged from the tub 122, a pump 136 which discharges wash water from the tub 122, a circulation path 137 which circulates wash water in the tub 122, and a water-drain path 138 which guides the wash water discharged from the tub 122 to the outside of the washing machine 100 may also be provided in the cabinet 111. The pump 136 may include a circulation pump and a water-drain pump connected to the circulation path 137 and the water-drain path 138, respectively. The first spray nozzle 127 may spray wash water from the circulation path 137 and may be provided at the gasket 118.

The control panel 114 may include an input unit **114*b* which allows a user to select one of a plurality of wash courses. The input unit 114*b* also receives various operation commands for determining the duration of an operational cycle or for scheduling a washing operation. The control panel 114 also may include a display unit 114*a* which displays information indicating the operating state of the washing machine 100**.

Figure 4:
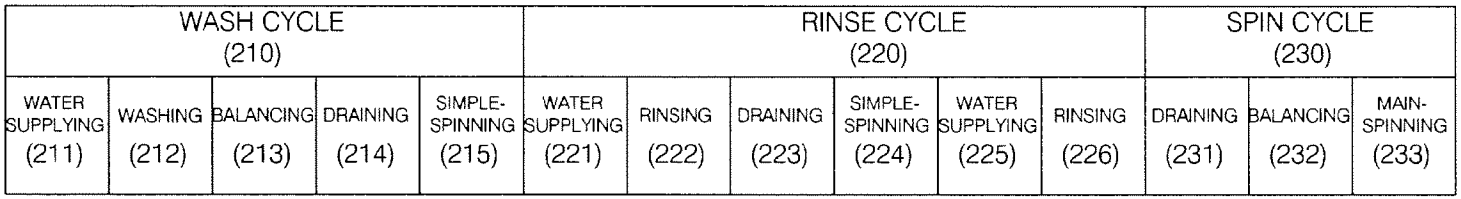
FIGS. 4 and 5 illustrate the operation of the washing machine shown in FIG. 1.

The plurality of washing courses may include a standard-wash course, winter clothes-wash course, a lingerie/knitwear-wash course, a boil-wash course, a speed-wash course, a functional clothes-wash course, a bedclothes-wash course, and a gentle-wash course. The operation of the washing machine 100 may be largely divided into a wash cycle, a rinse cycle and a spin cycle as illustrated in FIG. 4. Each of the wash cycle, the rinse cycle and the spin cycle may include a water supply process, a wash process, a rinse process, a spin process and/or a dry process.

Figure 3:
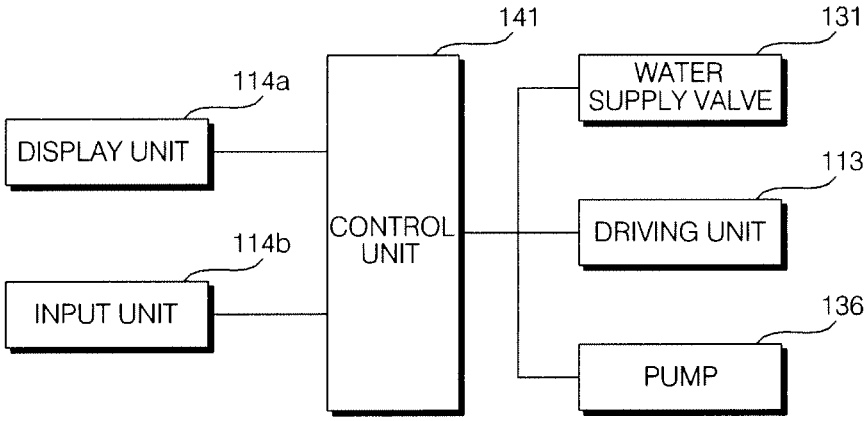
FIG. 3 illustrates a block diagram of the washing machine shown in FIG. 1.

FIG. 3 is a block diagram of the washing machine 100. Referring to FIG. 3, the washing machine 100 includes a control unit 141, which may control the general operation of the washing machine 100 according to the operation command received by the input unit **114*b*. The control unit 141 may be provided in the control panel 114. The control unit 141 may include a mi-com to control the operation of the washing machine 100 and other electronic parts. The control unit 141 may determine whether a wash cycle, a rinse cycle and a spin cycle is to be performed, and if so, how many times a water supply process, a wash process, a rinse process, a spin process and a dry process, for example, should be performed during the wash cycle, rinse and/or spin cycle, and for how long each of the water supply process, the wash process, the rinse process, the spin process and/or the dry process should be performed based on the specific wash course selected by the user. The control unit 141 may also control the water supply valve 131, the driving unit 113 and the pump 136** according to the specific wash course selected by the user and/or other operation commands input by the user.

Figure 5:
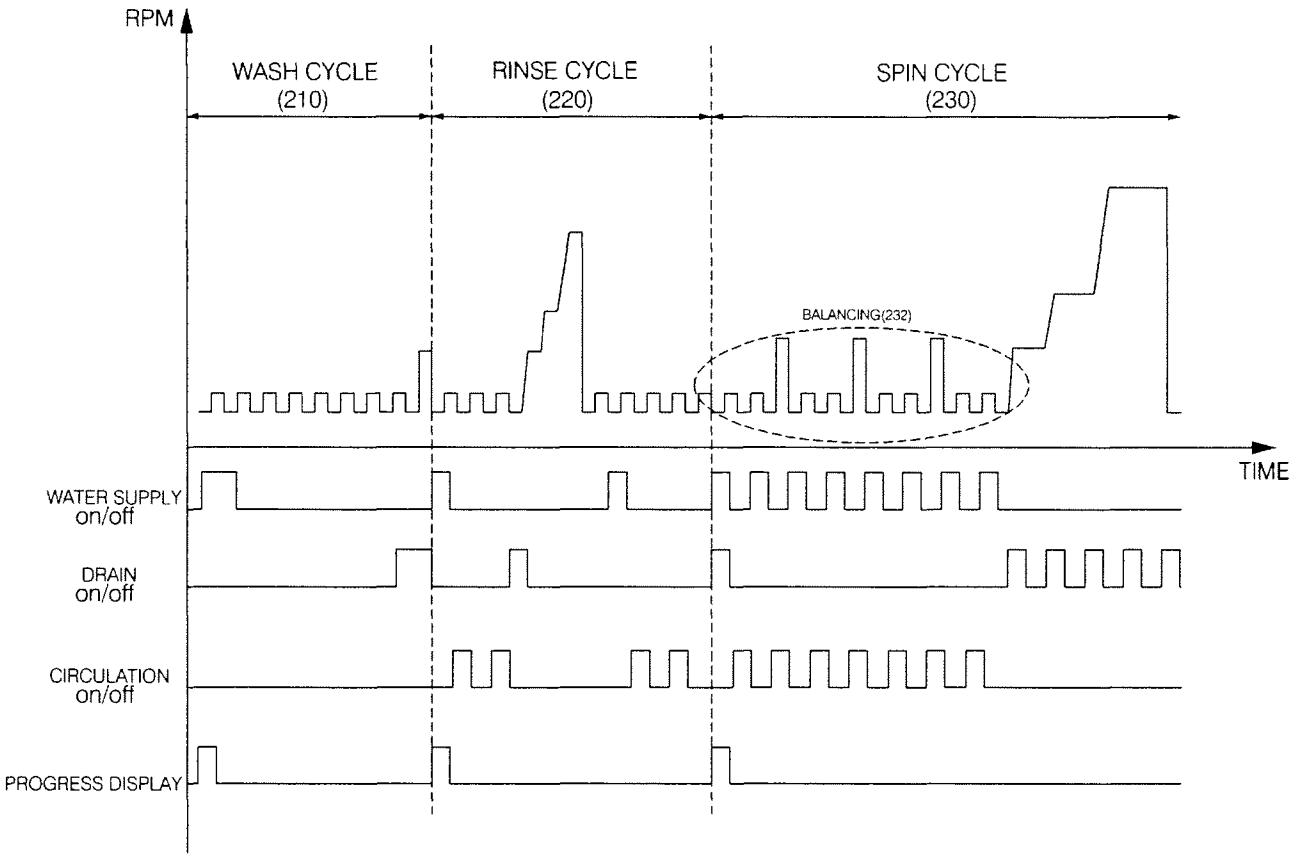
Figure 6:
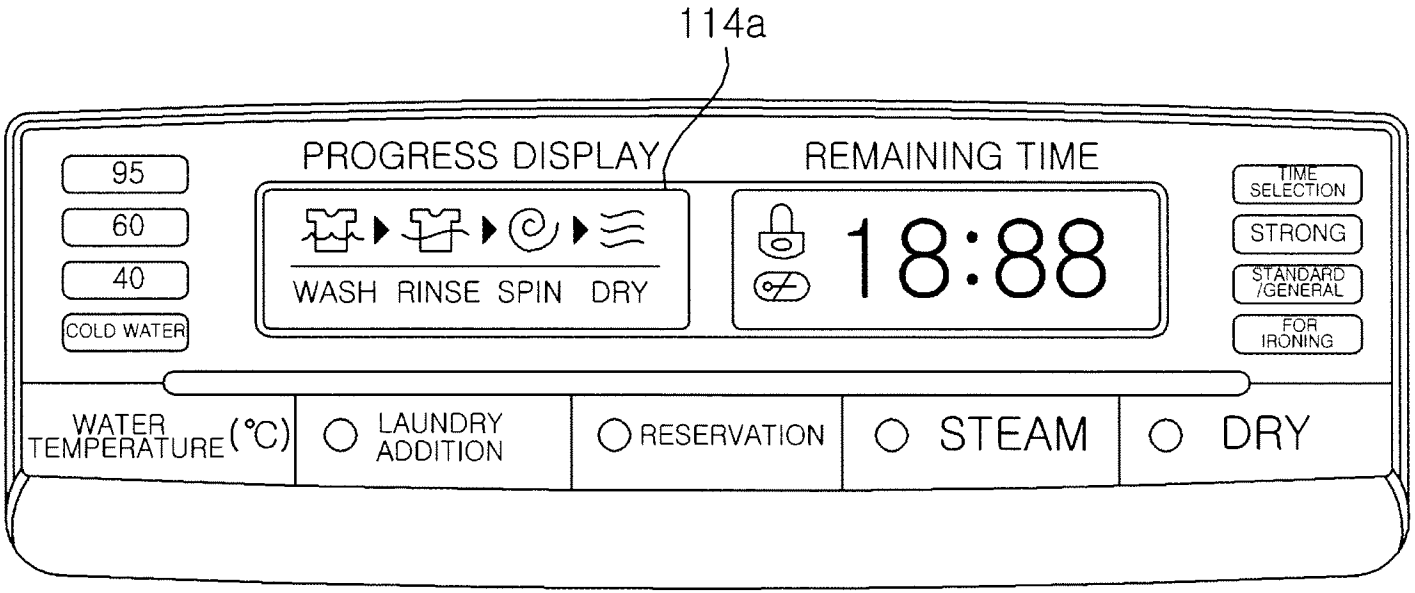
FIG. 6 illustrates the display unit shown in FIG. 1.

FIGS. 4 and 5 are diagrams for explaining the operation of the washing machine 100, whereas, FIG. 6 is a diagram of the display unit **114*a*. Referring to FIGS. 4 and 5, a wash cycle 210 may be generally characterized by soaking laundry in wash water mixed with detergent and rotating the drum 124 so as to remove dust and dirt from the laundry. The wash cycle 210 may be performed by sequentially carrying out a water supply process 211, a wash process 212, a laundry-balancing process 213, a water-draining process 214 and a sub-spin process 215**.

When the wash cycle 210 begins, the control unit 141 may display a wash icon on the display unit **114*a*, as shown in FIG. 6. This alerts the user that the wash cycle 210** has begun.

The water supply process 211 may be generally characterized by supplying wash water from an external water source into the tub 122 and drum 124. During the water supply process 211, the control unit 141 opens the water supply valve 131, and wash water from an external water source is supplied to the detergent box 133 via the first water supply path 132. There, the wash water mixes with detergent, and is subsequently supplied to the tub 122 via the water supply tube 134. The wash water may mix with bleach and/or other like cleaning items in detergent box 133.

During the water supply process 211, the control unit 141 may cause the driving unit 113 to rotate the drum 124 so as to allow the laundry to be well soaked in the mixture of wash water and detergent. The water supply process 211 may continue until the water level in the tub 122 reaches a target level. The control unit 141 may control the target level based on the amount of laundry (i.e., laundry load) measured before the water supply process 211 begins or the wash course is selected by the user. The water level in the tub 122 may be measured by a water level measurement device (not shown).

The laundry load may be measured in various manners. In this exemplary embodiment, the driving unit 113 may rotate the drum 124 at a predefined speed. The control unit 141 may then measure the time that it takes to decelerate the drum 124. The more time that it takes to decelerate the drum 124, the greater the laundry load.

When the wash water being supplied into the tub 122 reaches the target level, the control unit 141 closes the water supply valve 131. In general this terminates the water supply process 211.

The washing process 212 may be generally characterized by rotating the drum 124 when the laundry is soaked with the mixture of wash water and detergent. During the washing process 212, the control unit 141 causes driving unit 113 to rotate the drum 124. When this occurs, the laundry in the drum 124 is repeatedly lifted by the lifter 125. Thus, dust and dirt is removed from the laundry due to the friction in the laundry and the repeated lifting and falling of the laundry in the drum 124.

During the washing process 212, the control unit 141 may control the driving unit 113 to rotate the drum 124 at various speeds or in various directions. In this exemplary embodiment, the drum 124 may rotate the drum 124 at a speed of about 40 rpm in a uniform direction. This allows the laundry in the drum 124 to be repeatedly lifted and dropped inside the drum 124. In order to prevent the driving unit 113 from becoming overheated during the washing process 212, the control unit 141 may stop the driving unit 113 at intervals of several seconds to several minutes.

Still further, during the washing process 212, steam may be injected into the drum 124. In addition, the control unit 141 drives the pump 136 to circulate wash water in the tub 122 through the circulation path 137.

The laundry-balancing process 213 may be generally characterized by repeatedly accelerating and decelerating the drum 124 so as to evenly distribute laundry in the drum 124. If and when laundry gets tangled during the washing process 212, the eccentricity of the laundry may increase. This, in turn, may result in excessive vibration and noise during the sub-spinning process 215. Thus, it is necessary to perform the laundry-balancing process 213 before the sub-spinning process 215.

The water-draining process 214 may be generally characterized by draining wash water from the tub 122 to the outside of the cabinet 111. During the water-draining process 214, the control unit 141 drives the pump 136 to discharge the wash water in the tub 122 to the outside of the cabinet 111 along the water-drain path 138.

The sub-spinning process 215 may be generally characterized by spinning the drum 124 at high speed so as to extract excess wash water remaining in the laundry. During the sub-spinning process 215, the control unit 141 drives the driving unit 113 to rotate the drum 124 at such high speed that the laundry may adhere to the inner sidewall of the drum 124 due to centrifugal force. The excess wash water remaining in the laundry is extracted by the same centrifugal force. The laundry does not need to be completely dried out by the sub-spinning process 215. Thus, during the sub-spinning process 215, the drum 124 may be rotated at a speed of, for example, about 108 rpm.

During the sub-spinning process 215, the control unit 141 may also drive the pump 136 to discharge the wash water in the tub 122 to the outside of the cabinet 111 through the water-drain path 138.

A rinse cycle 220 may be generally characterized by soaking laundry in the mixture of wash water and, if desired, fabric softener. The drum 124 is rotated to remove detergent remaining in the laundry. The rinse cycle 220 may be performed by sequentially carrying out a water supply process 221, a rinse process 222, a water-draining process 223, a sub-spinning process 224, a second water supply process 225 and a second rinse process 226. In this exemplary embodiment, the rinse cycle 220 includes two rinse processes, i.e., the rinse processes 222 and 226. However, the present invention is not restricted to this. That is, the rinse cycle 220 may not include any rinse process or may include more than two rinse processes.

When the rinse cycle 220 begins, the control unit 141 may display a rinse icon on the display unit 114*a*, as shown in FIG. 6. This alerts the user that the rinse cycle 220 has begun.

The water supply process 221, like the water supply process 211 of the wash cycle 210, may be generally characterized by supplying wash water from an external water source into the tub 122. During the water supply process 221, wash water supplied via the first water supply path 132 may be directed into the tub 122 via the water supply tube 134. Wash water may also be supplied via the second water supply path 139 and sprayed onto the laundry in the drum 124 via the second spray nozzle 129. For this, the control unit 141 may control the water supply valve 131 to selectively supply wash water via the first water supply path 132 and/or the second water supply path 139 according to a predefined algorithm.

During the water supply process 221, the control unit 141 may cause the driving unit 113 to rotate the drum 124 so as to allow the laundry to be well soaked in wash water.

The rinse process 222 may be generally characterized by rotating the drum 124 when laundry soaked in wash water is contained in the drum 124. Consequently, the laundry in the drum 124 is repeatedly lifted by the lifter 125. Thus, detergent remaining in the laundry, as well as dust and dirt can be removed due to friction and due to the lifting and the falling of the laundry in the drum 124.

During the rinse process 222, the control unit 141 causes the driving unit 113 to rotate the drum 124 at various speeds or in various directions. In this exemplary embodiment, the drum 124 spins the drum 124 at a speed of about 40 rpm in a uniform direction. This allows the laundry in the drum 124 to be repeatedly lifted and dropped inside the drum 124. During the rinse process 222, the control unit 141 may also drive the pump 136 to circulate wash water in the tub 122 along the circulation path 137.

The water-draining process 223, like the water-draining process 214 of the wash cycle 210, may be generally characterized by draining the wash water in the tub 122 to the outside of the cabinet 111.

The sub-spinning process 224, like the sub-spin process 215 of the wash cycle 210, may be generally characterized by rotating the drum 124 at such high speed so that the wash water remaining in the laundry can be extracted. The drum 124 may be rotated at a higher speed during the sub-spinning process 224 than during the sub-spinning process 215 of the wash cycle 210. For example, the drum 124 may be spun at a speed of about 800 rpm.

The water supply process 225, like the water supply process 221, may be generally characterized by supplying wash water from an external water source into the tub 122. The wash water supplied during the water supply process 225 may be mixed with fabric softener, and may then be injected into the tub 122. During the water supply process 225, the control unit 141 may cause the driving unit 113 to rotate the drum 124 so as to allow the laundry to be well soaked in the mixture of wash water and, if used, fabric softener.

The rinse process 226, like the rinse process 222, may be generally characterized by rotating the drum 124 when laundry soaked in wash water is contained in the drum 124. During the rinse process 226, like the rinse process 222, the laundry in the tub 122 may be softened by fabric softener mixed in the wash water.

Additionally, during the water supply process 221, the rinse process 222, the water-drain process 223 and the sub-spin process 234 may be performed while spraying wash water onto the laundry in the tub 122 through the second spray nozzle 139. Still further, it is possible to improve the efficiency of rinsing and reduce the amount of water used for rinsing by directly spraying wash water onto laundry. In addition, it is possible to prevent laundry from being soiled with used wash water by directly draining wash water extracted from the laundry.

A spin cycle 230 may be generally characterized by rotating the drum 124 at high speed so as to extract wash water from the laundry. In this exemplary embodiment, the spin cycle 230 may include a water-draining process 231, a laundry-balancing process 232 and a main spinning process 233.

Once the spin cycle 230 begins, the control unit 141 may display a spin icon on the display unit 114*a*, as shown in FIG. 6, and may thus alert the user to the beginning of the spin cycle 230. The water-draining process 231 may be performed for a predefined amount of time or it may be performed until the water level in the tub 122 decreases below a reference level.

During the water-draining process 231, the wash icon displayed on the display unit 114*a* may be illuminated in order to indicate that the water-draining process 231 is being performed.

The laundry-balancing process 232 may be generally characterized by repeatedly accelerating and decelerating the drum 124 so as to evenly distribute laundry in the drum 124. If and when laundry gets tangled during the wash cycle 210 or the rinse cycle 220, the eccentricity of the laundry may increase. This, in turn, may result in excessive vibration and noise during the main spinning process 233. Thus, it is necessary to perform the laundry-balancing process 232 before the main spinning process 233.

It should be noted that in FIG. 5, the laundry balancing process 232 is shown as being accomplished at the beginning of the spin cycle 230. However, it will be understood that the laundry balancing process 232 could also be accomplished at the end of the rinse cycle 220.

During the laundry-balancing process 232, the drum 124 may be accelerated to the extent that the laundry adheres to the inner sidewall of the drum 124. For example, during the laundry-balancing process 232, the drum 124 may be accelerated to a speed of, for example, about 70-80 rpm, and then decelerated. Furthermore, during the laundry-balancing process 232, the control unit 141 may determine the degree of imbalance of the laundry in the drum 124 is unbalanced based on the rotation speed of the drum 124.

The degree of imbalance of the laundry in the drum 124 may be determined in various ways. In this exemplary embodiment, the degree of imbalance of the laundry in the drum 124 is determined by accelerating the drum 124 and then determining a variation in the rotation speed of the drum 124.

The control unit 141 may accelerate and decelerate the drum 124 in various ways according to the degree of imbalance. That is, the control unit 141 may vary the acceleration and/or deceleration of the drum 124 according to the degree of imbalance.

The rotation speed of the drum 124 may be measured by a sensor. Alternatively, the rotation speed may be determined by measuring the amount of current that flows in the motor of the driving unit 113. The control unit 141 may determine the degree of imbalance based on the difference between the variation in the rotation speed of the drum 124 and a reference variation level. The reference variation level may vary according to the amount of laundry in the drum 124. If the measured imbalance is less than the reference variation level, the laundry-balancing process 232 may be skipped.

During the laundry-balancing process 232, the control unit 141 may determine the amount of laundry in the drum 124 in various ways. In this exemplary embodiment, the control unit 141 determines the amount of laundry based on the time required to decelerate the drum 214. The less time required, the larger the amount of laundry in the drum 124. Alternatively, the control unit 141 may determine the amount of laundry based on the time required to accelerate the drum 214.

Thereafter, a variation in the volume of the laundry in the drum 124 may be estimated based on the degree of imbalance in the laundry in the drum 124 and the amount of laundry in the drum 124. Thereafter, wash water may be sprayed into the drum 124 according to at least one of the degree of imbalance in the laundry in the drum 124 and the amount of laundry in the drum 124.

When the laundry-balancing process 232 is complete, the main spinning process 233 may be performed. The main spinning process 233 may be generally characterized by spinning the drum 124 at high speed so as to extract wash water from the laundry. During the main spinning process 233, the control unit 141 causes the drum 124 to spin at high speed. The centrifugal force that acts on the laundry due to the high speed rotation of the drum 124 may cause the laundry in the drum 124 to adhere onto the inner sidewall of the drum 124, and wash water to be extracted from the laundry. The drum 124 may be spun at a higher speed during the main spin process 233 than during the sub-spin process 215 of the wash cycle 210 or during the sub-spin process 224 of the rinse cycle 220. For example, during the main spin process 233, the drum 124 may be spun at a speed of about 1000 rpm or higher.

During the main spinning process 233, the control unit 141 may drive the pump 136 to discharge the wash water in the tub 122 through the water-drain path 138. The main spinning process 233 may be followed by a drying process. During the drying process, hot air may be supplied to the drum 124 so as to dry the laundry in the drum 124.

Figure 7:
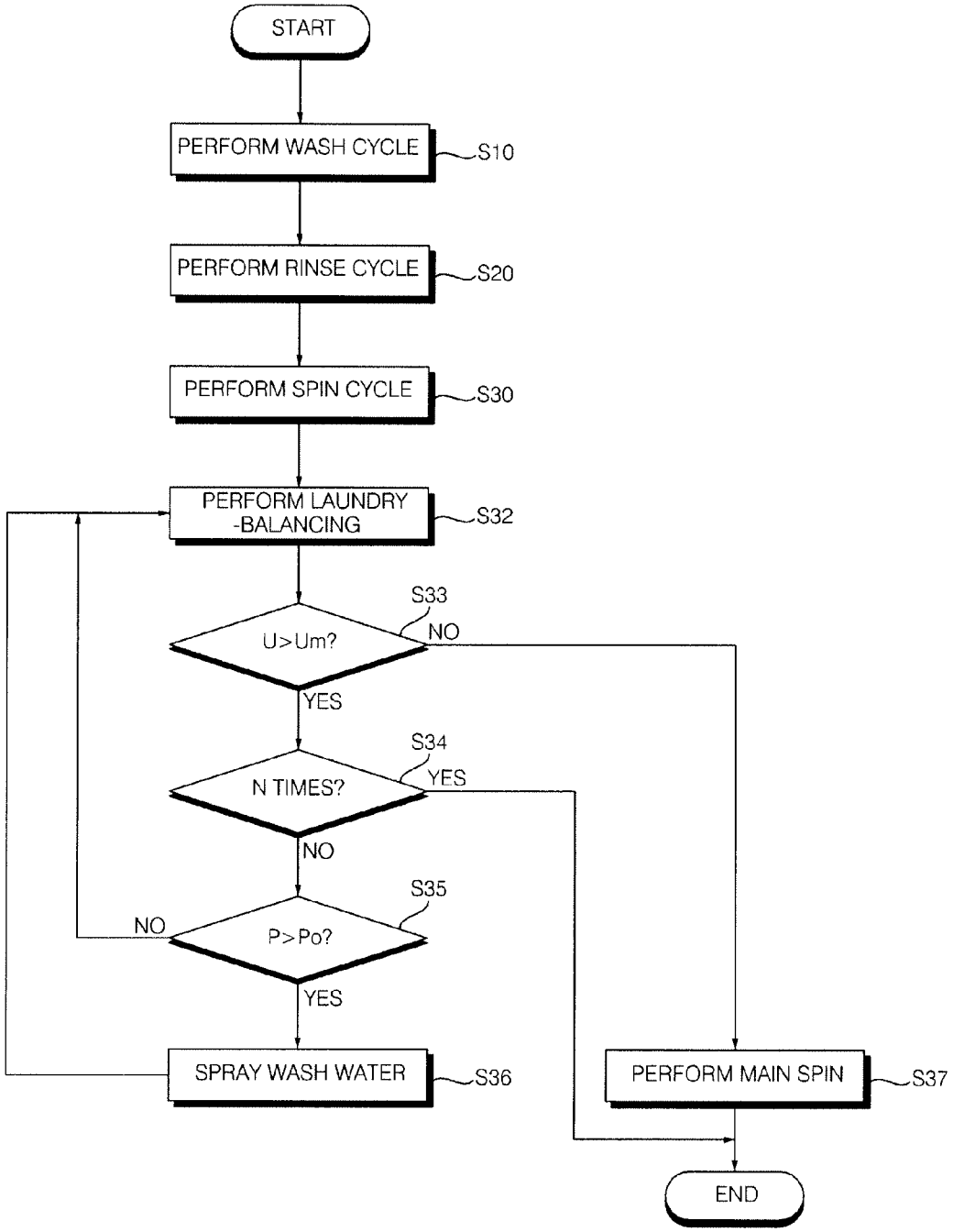
FIG. 7 is a flowchart for a method of washing laundry according to an exemplary embodiment of the present invention.

FIG. 7 is a flowchart illustrating a washing method according to an exemplary embodiment of the present invention. It should be noted that the user may set the washing machine 100 to perform all of the cycles: the wash cycle, the rinse cycle and the spin cycle. Alternatively, the user may select fewer than all of the cycles and set the washing machine 100 to perform only the selected cycle(s). In this exemplary embodiment, a wash cycle, a rinse cycle and a spin cycle are all performed.

As shown in FIG. 7, the wash cycle and the rinse cycle are performed in operations S10 and S20, respectively. The wash cycle and the rinse cycle were described above with reference to FIGS. 4 and 5, and thus, a further description thereof will be omitted here.

Thereafter, a spin cycle may be performed (S30). More specifically, wash water in the tub 122 may be discharged, e.g., by performing water-draining process 231 described above. The water-draining process may be particularly important for laundry that is capable of absorbing a relatively large amount of water during the rinse cycle such as cotton, wool and many types of winter clothes. Because different types of clothing absorb different amounts of wash water, the washing machine 100 may offer different wash courses, such as a bedding-wash course or a winter clothes-wash course, and the user may have the option to select one of the wash courses using the input unit 114*b*.

When the spin cycle begins, the control unit 141 may drive the pump 136. It may also control display unit 114*a* to output a message indicating that the spin cycle has begun. Alternatively, an alarm unit may be used to output a text message and/or an audio output message.

The pump 136 may be continuously driven for a predefined amount of time. Alternatively, the pump 136 may be driven until a water level sensor (not shown) determines that the water level in the tub 122 has decreased to a predefined level. In operation, the pump 136 may be repeatedly turned on or off according to predefined duration and frequency setting, or it may be repeatedly turned on or off based on the water level in the tub 122.

Thereafter, a laundry-balancing process may be performed (S32). As stated above, this involves accelerating and decelerating the rotation of the drum 124. Next, drum eccentricity U and laundry load P are measured, as indicated in S33 and S35, respectively.

These measurements will be used to determine whether it is preferable to spray wash water into drum 124 to aid in the laundry balancing process, as will be explained in greater detail below.

In accordance with S33, the measured degree of imbalance U (i.e., the eccentricity of the drum 124) is compared to an allowable degree of imbalance Um. Then, if the control unit 141 determines, based on the comparison, that the measured degree of imbalance U is less than or equal to the allowable degree of imbalance Um, which might indicate that the laundry is relatively well balanced, the control unit 141, as illustrated by the "NO" path out of S33, transitions to the main spin process, represented by S37.

If, on the other hand, the control unit 141 determines that the measured degree of imbalance U is greater than the allowable degree of imbalance Um, which might indicate that the laundry is unacceptably out of balance, as illustrated by the "YES" path out of S33, the control unit 141 will then establish whether a predetermined number N of attempts have already been made to balance the laundry. If a predetermined number N of attempts have been made to balance the laundry, and the laundry is still not balanced, as indicated by the fact that U is greater than Um, then the control unit 141 terminates the washing process, at least temporarily, as indicated by the "YES" path out of S34.

If a predetermined number N of attempts to balance the laundry have not yet been made, as indicated by the "NO" path out of S34, the control unit 141 will then compare the laundry load P to a reference laundry load Po, as represented by S35. In doing so, the control unit 141 is determining whether wash water should be sprayed onto the laundry to facilitate the laundry balancing process. Accordingly, if the control unit 141 determines that the laundry load P is greater than the reference laundry load Po, spraying wash water onto the laundry may be necessary to properly soak and, thereafter, aid in balancing the laundry. Thus, the control unit 141, pursuant to the "YES" path out of S35, will cause wash water to be sprayed into the drum as represented by S36. The control unit then tries again to balance the laundry as represented by S32, for example, by accelerating and decelerating the rotation of the drum 124. If, however, the control unit 141 determines that the laundry load P is less than or equal to the reference laundry load Po, spraying wash water may not be needed to help balance the laundry. Thus, pursuant to the "NO" path out of S35, the control unit 141 by-passes the wash water spraying process S36, and attempts, once again, to balance the laundry according to S32. It should be noted that the laundry load P may be measured prior to the spin cycle; in fact, it may be measured prior to the water supply process associated with the wash cycle.

As mentioned above, the variable N represents a predetermined number of times the control unit 141 should attempt to balance the laundry. Thus, the laundry balancing and, if necessary, the wash water spraying processes will be repeated at most N number of times. If, after attempting to balance the laundry N number of times, the laundry still is not balanced, the control unit terminates that washing process, at least temporarily, as indicated by the "YES" path out of S34, as stated previously.

The wash water spraying process S36 may be performed in various manners. For example, wash water may be supplied into the tub 122 via the water supply tube 134, via the first spray nozzle 127, or via the second spray nozzle 129. The wash water spraying process S36 does not need to be continuously performed. Instead, the wash water spraying process S36 may be performed at regular intervals of time during the laundry balancing process. In addition, was water may be added to the tub 122 until a given water level is reached as measured by a water level sensor.

A large laundry load P may not necessarily be indicative of a high percentage of water content in the laundry. However, if the amount of laundry in the drum 124 exceeds the reference level Po, it may be difficult to evenly distribute the laundry in the drum 124. Thus, the reference level Po should be appropriately established considering the percentage of water content of the laundry. That is, the reference level Po should be established so that a laundry-balancing process can be successfully performed whether or not the laundry has a low water-retaining capacity or a high water-retaining capacity.

The reference level Po may, for example, be determined experimentally based on the water-retaining power of the laundry which may depend on the material of the laundry. For example, cotton, wool and winter clothing generally have a high water-retaining capacity, and thus, the volume of this type of laundry may considerably vary according to the progression of the spin cycle. Therefore, the reference level Po may need to be appropriately determined in order to properly perform the laundry-balancing process for this type of laundry.

As stated above, the control unit 141 may determine that wash water should be sprayed into the drum 124, to aid in the laundry balancing process, pursuant to S36 and the "YES" path out of S35, as illustrated in FIG. 7. However, the process of spraying wash water into drum 124, as represented by S36, may involve introducing additional wash water and/or re-circulating wash water that already exists in the tub and drum. For example, it may be determined that the water content of the laundry is already sufficiently high. In this instance, the control unit 141, in executing the wash water spraying process S36, may cause the wash water that already exists in the tub and drum to be re-circulated. Alternatively, the control unit 141 may determine that the water content of the laundry is relatively low. Here, the control unit 141, in executing the wash water spraying process S36, may operate the water supply valve 131 and cause additional wash water to be introduced into the tub and drum. In either case, the control unit 141 may drive the pump 136 to circulate and/or re-circulate wash water through the aforementioned circulation paths and spray nozzles to aid in the laundry balancing process.

According to the present invention, it is possible to improve the mobility of laundry in the drum by evenly distributing the laundry in the drum. In addition, according to the present invention, it is possible to reduce vibration and noise due to vibration during the spin cycle by evenly distributing laundry in the drum and spinning the drum at high speed. Still further, it is possible to evenly distribute laundry that has a high water-retaining capacity and thus reduce the time needed to begin the spin cycle.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A laundry washing method for a washing machine that includes a tub and a drum arranged within the tub, the drum being rotatable about a horizontal axis, said method comprising:

draining wash water from the tub prior to initiating a main spinning process;

comparing a degree of laundry imbalance to a laundry imbalance reference level, when the degree of laundry imbalance is less than the laundry imbalance reference level, performing the main spinning process by spinning the drum at a high speed thereby extracting wash water from the laundry, based on the comparison of the degree of laundry imbalance to the laundry imbalance reference level, and when the degree of laundry is greater than the laundry imbalance reference level, comparing a laundry load to a reference laundry load;

determining whether to spray wash water into the drum based on the comparison that the laundry load is greater than the reference laundry load;

redistributing the laundry in the drum by repeatedly accelerating and decelerating the rotation of the drum;

spraying wash water into the drum during the redistributing the laundry in the drum based on the determination of whether to spray wash water into the drum; and performing the main spinning process by spinning the drum at a high speed thereby extracting wash water from the laundry.

2. The washing method of claim 1, further comprising:

measuring a variation in the rotational speed of the drum: and measuring the degree of laundry imbalance as a function of the variation in the rotational speed of the drum.

3. The washing method of claim 1, further comprising:

measuring drum deceleration; and measuring laundry load as a function of drum deceleration.

4. The washing method of claim 1, further comprising:

measuring drum acceleration; and measuring laundry load as a function of drum acceleration.

5. The washing method of claim 1, wherein the comparing the degree of laundry imbalance to the laundry imbalance reference level and redistributing the laundry in the tub is performed a predetermined number of times.

6. The washing method of claim 1, wherein the comparing the degree of laundry imbalance to the laundry imbalance reference level and redistributing the laundry in the tub is performed until it is determined, based on the comparison of the degree of laundry imbalance to the laundry imbalance reference level, that the laundry has been redistributed to an acceptable degree.

7. The washing method of claim 1, wherein the spraying wash water into the drum is repeated a plurality of times until it is determined, based on a comparison of the degree of laundry imbalance to the laundry imbalance reference level, that the laundry has been redistributed to an acceptable degree.

8. The washing method of claim 1, wherein the spraying wash water into the drum is further based on a water level in the tub.

9. The washing method of claim 8, wherein the spraying wash water into the drum comprises:

spraying additional wash water if it is determined that the water level in the tub is less than a reference water level.

10. The washing method of claim 1, wherein the spraying wash water into the drum comprises:

re-circulating wash water drained from the tub.

11. The washing method of claim 1, wherein the washing machine is capable of performing a rinse cycle and a spin cycle, wherein the main spinning process is performed during the spin cycle, and wherein the spraying wash water into the drum is performed as part of the spin cycle.

12. The washing method of claim 1, wherein the washing machine is capable of performing a rinse cycle and a spin cycle, wherein the main spinning process is performed during the spin cycle, and wherein the spraying wash water into the drum is performed as part of the rinse cycle.

13. The washing method of claim 1, wherein the spraying wash water into the drum comprises:

repeatedly spraying wash water at regular time intervals.

14. A washing machine comprising:

a tub;

a drum positioned within the tub and being rotatable about a horizontal axis;

a driving unit configured for rotating the drum;

a spray nozzle configured for spraying wash water into the drum;

a pump; and a control unit configured to:

operate the pump so as to drain wash water from the tub prior to the initiation of a main spinning process;

compare a degree of laundry imbalance to a laundry imbalance reference level;

when the degree of laundry imbalance is less than the laundry imbalance reference level, perform the main spinning process by spinning the drum at a high speed thereby extracting wash water from the laundry, based on the comparison of the degree of laundry imbalance to the laundry imbalance reference level;

when the degree of laundry imbalance is greater than the laundry imbalance reference level, compare a laundry load to a reference laundry load;

determine whether to spray wash water into the drum based on the comparison that the laundry load is greater than the reference laundry load;

control the driving unit to accelerate and decelerate drum rotating thereby redistributing laundry inside the drum;

control wash water to be sprayed through the spray nozzle while the rotation of drum is accelerated and decelerated based on the determination of whether to spray wash water into the drum; and initiate the main spinning process by activating the driving unit to rotate the drum at a high speed thereby extracting wash water from the laundry.

15. The washing machine of claim 14, wherein the control unit controls the spraying of wash water into the drum and at the same time controls the driving unit to accelerate and decelerate the drum rotating thereby redistributing laundry inside the drum.

16. The washing machine of claim 14, wherein the control unit is further configured to re-circulate wash water into the drum, and the re-circulated wash water is introduced to the spray nozzle.

17. The washing machine of claim 14, wherein the control unit is further configured to:

control the driving unit to accelerate and decelerate drum rotation a plurality of times, thereby redistributing laundry inside the drum a plurality of times.

18. The washing machine of claim 14, wherein the control unit is further configured to:

cause wash water to be sprayed into the drum a plurality of times until the control unit determines that the laundry in the drum has been redistributed to an acceptable degree.

19. The washing machine of claim 14, wherein the washing machine is capable of performing a rinse cycle and a spin cycle, and wherein during the rinse cycle, the control unit is further configured to:

control the spraying of wash water into the drum based on the comparison of the laundry load to the reference laundry load, that the laundry load is greater than the reference laundry load and control the driving unit to accelerate and decelerate drum rotation while the wash water is being sprayed into the drum thereby redistributing laundry inside the drum.

20. The washing machine of claim 14, wherein the washing machine is capable of performing a rinse cycle and a spin cycle, and wherein during the spin cycle, the control unit is further configured to:

control the spraying of wash water into the drum based on the comparison of the laundry load to the reference laundry load, that the laundry load is greater than the reference laundry load and control the driving unit to accelerate and decelerate drum rotation while the wash water is being sprayed into the drum thereby redistributing laundry inside the drum.

* * * * *